US007926239B2

(12) United States Patent
Hahn et al.

(10) Patent No.: US 7,926,239 B2
(45) Date of Patent: Apr. 19, 2011

(54) FLOORING PROFILE

(75) Inventors: Kris Hahn, Roswell, GA (US); Jean Briere, Ooltewah, TN (US); Tryggvi Magnusson, Wausau, WI (US)

(73) Assignee: Columbia Insurance Company, Omaha, NE (US)

( * ) Notice: Subject to any disclaimer, the term of this patent is extended or adjusted under 35 U.S.C. 154(b) by 478 days.

(21) Appl. No.: 11/395,035

(22) Filed: Mar. 31, 2006

(65) Prior Publication Data

US 2007/0245663 A1 Oct. 25, 2007

(51) Int. Cl.
*E04B 2/00* (2006.01)

(52) U.S. Cl. ..... 52/592.1; 52/589.1; 52/590.2

(58) Field of Classification Search ..... 52/391, 52/390, 592.1, 589.1, 590.2
See application file for complete search history.

(56) References Cited

U.S. PATENT DOCUMENTS

| | | | | | |
|---|---|---|---|---|---|
| 174,261 | A | * | 2/1876 | Kuhn | 52/506.05 |
| 316,175 | A | | 4/1885 | Putney | |
| 337,564 | A | * | 3/1886 | Daugherty | 52/592.1 |
| 890,436 | A | * | 6/1908 | Momberg | 52/506.01 |
| 1,124,228 | A | * | 1/1915 | Houston | 403/381 |
| 1,430,996 | A | | 10/1922 | Horlin | |
| 1,472,521 | A | | 10/1923 | Harrison | |
| 1,764,331 | A | * | 6/1930 | Moratz | 52/364 |
| 1,778,068 | A | | 10/1930 | Fetz | |
| 1,778,069 | A | | 10/1930 | Fetz | |
| 1,778,352 | A | | 10/1930 | Bruce | |
| 1,832,397 | A | | 11/1931 | Hultquist | |
| 1,859,667 | A | * | 5/1932 | Gruner | 52/578 |
| 1,925,068 | A | | 8/1933 | Gray | 20/8 |
| 1,936,028 | A | | 11/1933 | Rockwell | |
| 1,986,739 | A | | 1/1935 | Mitte | 72/19 |
| 2,017,185 | A | | 1/1935 | Rockwell | |
| 2,004,917 | A | | 6/1935 | Johnson | 20/8 |
| 2,031,596 | A | | 2/1936 | Fulbright | 20/8 |
| 2,045,068 | A | | 6/1936 | Bruce | 20/8 |
| 2,092,694 | A | | 9/1937 | Crooks | |
| 2,114,451 | A | | 4/1938 | Mattes | 72/23 |
| 2,152,694 | A | | 4/1939 | Hoover | |
| 2,226,540 | A | | 12/1940 | Boettcher | |
| 2,227,878 | A | | 1/1941 | Crooks | 20/8 |

(Continued)

FOREIGN PATENT DOCUMENTS

WO WO 94/06606 3/1994

(Continued)

OTHER PUBLICATIONS

International Search Report (mailed Sep. 2, 2008) for International Application No. PCT/US07/08245 (filed Mar. 30, 2007).

*Primary Examiner* — Jeanette E Chapman
*Assistant Examiner* — Daniel Kenny
(74) *Attorney, Agent, or Firm* — Ballard Spahr LLP

(57) ABSTRACT

The invention relates to a flooring panel having opposed pairs of substantially parallel side edges, a tongue connector member, and a groove connector member. In one aspect, the tongue connector member extends along one side edge and the groove connector member extends along the opposed side edge. The tongue connector member and the groove connector member are configured to cooperatively couple with each other such that portions of the coupled flooring panels are positioned in abutting relationship.

39 Claims, 6 Drawing Sheets

U.S. PATENT DOCUMENTS

| | | | | |
|---|---|---|---|---|
| 2,269,926 | A | 1/1942 | Crooks | 20/7 |
| 2,269,927 | A | 1/1942 | Crooks | 20/7 |
| 2,328,051 | A | 8/1943 | Bull | |
| 2,817,125 | A | 12/1957 | Johns | 20/8 |
| 2,874,603 | A | 2/1959 | Boettcher | 85/28 |
| 3,200,553 | A | 8/1965 | Frashour et al. | 52/595 |
| 3,551,270 | A | 12/1970 | Sharkey | 161/113 |
| 3,567,563 | A | 3/1971 | Haudenchild et al. | 161/37 |
| 3,577,694 | A | 5/1971 | Omholt | 52/483 |
| 3,579,941 | A | 5/1971 | Tibbals | 52/384 |
| 3,596,422 | A | 8/1971 | Boettcher | 52/368 |
| 3,619,963 | A | 11/1971 | Omholt | 52/483 |
| 3,740,910 | A | 6/1973 | Taylor et al. | 52/315 |
| 4,100,710 | A * | 7/1978 | Kowallik | 52/309.9 |
| 4,489,512 | A | 12/1984 | Schovee | 40/154 |
| 4,599,842 | A | 7/1986 | Counihan | 52/586 |
| 4,782,989 | A | 11/1988 | Wallin et al. | 227/149 |
| 4,831,806 | A | 5/1989 | Niese et al. | 52/391 |
| 4,856,250 | A | 8/1989 | Gronau et al. | 52/480 |
| 4,890,434 | A | 1/1990 | Niese | 52/393 |
| 5,016,413 | A | 5/1991 | Counihan | 52/391 |
| 5,088,260 | A | 2/1992 | Barton et al. | 52/416 |
| 5,465,548 | A | 11/1995 | Niese | 52/741.1 |
| 5,500,980 | A * | 3/1996 | Morrow et al. | 16/16 |
| 5,570,554 | A * | 11/1996 | Searer | 52/539 |
| 5,609,000 | A | 3/1997 | Niese | 52/480 |
| 5,706,621 | A | 1/1998 | Pervan | 52/403.1 |
| 5,879,781 | A | 3/1999 | Mehta et al. | 428/137 |
| 5,894,700 | A | 4/1999 | Sweet | 52/391 |
| 6,182,413 | B1 | 2/2001 | Magnusson | 52/589.1 |
| RE37,615 | E | 4/2002 | Niese | 52/480 |
| 6,484,467 | B2 * | 11/2002 | Crout | 52/483.1 |
| 6,610,228 | B2 | 8/2003 | Capps | 264/109 |
| 6,637,169 | B2 | 10/2003 | Niese et al. | 52/480 |
| 6,682,254 | B1 | 1/2004 | Olofsson et al. | 403/375 |
| 6,715,253 | B2 | 4/2004 | Pervan | 52/578 |
| 6,752,565 | B2 * | 6/2004 | Schrage | 404/25 |
| 6,851,241 | B2 | 2/2005 | Pervan | 52/592.1 |
| 6,918,221 | B2 | 7/2005 | Williams | 52/592.1 |
| 6,968,664 | B2 | 11/2005 | Thiers et al. | 52/592.1 |
| 2002/0144479 | A1 | 10/2002 | Chun et al. | 52/478 |
| 2003/0115829 | A1 | 6/2003 | Southern et al. | 52/746.1 |
| 2003/0121226 | A1 | 7/2003 | Bolduc | 52/391 |
| 2003/0208980 | A1 | 11/2003 | Miller et al. | 52/592.1 |
| 2004/0040242 | A1 | 3/2004 | Randjelovic | 52/403.1 |
| 2004/0098926 | A1 | 5/2004 | Haytayan | 52/40 |
| 2004/0098927 | A1 | 5/2004 | Haytayan | 52/40 |
| 2004/0107665 | A1 | 6/2004 | Faxe et al. | 52/578 |
| 2004/0141804 | A1 | 7/2004 | Olofsson et al. | 403/267 |
| 2004/0182034 | A1 | 9/2004 | Eberle, III | 52/586.1 |
| 2005/0005558 | A1 | 1/2005 | Bolduc | 52/582.1 |
| 2005/0039413 | A1 | 2/2005 | Schrotenboer | 52/582.1 |
| 2005/0144878 | A1 | 7/2005 | Grafenauer | |
| 2005/0221904 | A1 | 10/2005 | Ford et al. | 473/115 |
| 2005/0252143 | A1 | 11/2005 | Tataei | 52/582.1 |
| 2005/0268571 | A1 * | 12/2005 | Magnusson | 52/590.2 |
| 2006/0010818 | A1 | 1/2006 | Knauseder | 52/581 |

FOREIGN PATENT DOCUMENTS

| | | |
|---|---|---|
| WO | WO 03/048482 | 6/2003 |
| WO | WO 03/078750 | 9/2003 |
| WO | WO 2005/098164 | 10/2005 |
| WO | WO 2005/103411 | 11/2005 |

* cited by examiner

FLOORING PROFILE

FIELD OF THE INVENTION

The present invention pertains to a flooring profile. More specifically, the invention is a flooring profile for use with a hardwood or engineered hardwood flooring board.

BACKGROUND OF THE INVENTION

Hardwood flooring has become a very popular choice in floor coverings. Traditional hardwood floors are made from a variety of wood planks and are placed in side-by-side relation to each other with the side edges being engaged with a tongue and groove arrangement. In order to secure the floorboard to the subfloor, nails are driven at an angle through a portion of the tongue of the plank and into the subfloor below.

One common substitute for hardwood flooring is laminate flooring. Laminate flooring is made to look like hardwood, but is easier to install and less expensive. Laminated flooring members typically comprise a decorative surface layer, a core, a balancing backing layer, and a wear layer, which are bonded together. The decorative surface layer can be made of a resin, such as, for example a melamine/aluminum oxide based resin. The decorative surface layer is typically bonded to a moisture resistant core that can be formed from, for example, a wood composition.

Conventional cores are made of high or medium density fiberboard that is typically saturated in resins to make them extremely hard. This allows the laminate flooring members to be cut with an edge profile, such as a tongue and complementary groove, as desired, for ease of installation.

The balancing backing layer is applied to the underside of the core to help stabilize the laminate flooring member and to act as another barrier against moisture entering the laminate flooring member from below. Most manufacturers saturate the backing layer with resin to resist moisture intrusion and to make the balancing backing layer more dimensionally stable. In conventional construction, laminate flooring members formed with a balancing backing layer are not typically glued directly to the sub floor.

The wear layer is applied to provide protection and stain resistance to protect the top of the laminate flooring member. The wear layer is typically clear so that the aesthetic appearance of the decorative layer, including any color and/or printed image, is not obscured by the overlying wear layer. However, while great care is taken to ensure that the laminate flooring member looks like real hardwood flooring, any damage to the wear layer makes it evident that it is not true hardwood flooring.

Another alternative to hardwood flooring is engineered hardwood. An engineered hardwood flooring board is conventionally constructed with an upper layer, a middle layer and a lower layer. The upper layer is typically formed of conventional hardwood flooring material. The middle layer is conventionally formed of a non-hardwood material, such as medium density fiberboard, high density fiberboard, particle board, plywood and the like. The lower layer can also be formed from a hardwood material similar to the upper layer, or it can be formed from a non-hardwood material that has specially selected properties, such as water resistance or rigidity.

The upper layer of the engineered hardwood flooring board is formed of hardwood to give the board the appearance of conventional hardwood flooring and to enable the engineered hardwood flooring board to be sanded when damaged, similarly to a hardwood-only board.

Further, the use of alternative material as the middle layer, or core of the board, greatly increases the dimensional stability of the board, which allows the production of engineered hardwood flooring boards that are longer and wider than conventional hardwood flooring boards.

The material in the middle layer can be formed or milled precisely prior to assembly into the engineered hardwood flooring board, which results in boards with tight tolerances that can easily be engaged with one another to form the flooring surface. In one example, similar to conventional hardwood flooring boards, engineered hardwood flooring boards can comprise a tongue and a complementary groove positioned on and extending along opposite sides of the board. Alternatively, the boards can be secured to one another using a snap-fit profile, similar to those used in the laminate flooring industry.

Conventional method of installation may cause some installation issues when the engineered hardwood flooring boards are engaged with a traditional tongue and groove connection. Noteably, due to the increased density of the core material used in the middle layer portions of the core may be displaced when a nail or other fastener is driven into the top portion of the tongue, which causes a portion of the surface of the engineered hardwood flooring board to visibly protrude or bubble. In fact, this phenomenon often occurs in conventional hardwood flooring boards. What is needed is a flooring board and a method of installing an engineered hardwood flooring board that alleviates the problem of surface bubbling.

SUMMARY

In one embodiment, the present invention pertains to a flooring panel comprising opposed pairs of substantially parallel side edges, a tongue connector member, and a groove connector member. In one aspect, the tongue connector member extends along one side edge and the groove connector member extends along the opposed side edge.

In another aspect, the tongue connector member and the groove connector member are configured to cooperatively couple with each other such that portions of the coupled flooring panels are positioned in abutting relationship. In an exemplary aspect, when respective first and second flooring panels are coupled to each other along adjacent side edges, a distal end of the upper shoulder of the tongue connector member of the first flooring panel contacts or abuts a distal end of an upper lip of the groove connector member of the second flooring panel.

Other apparatus, methods, and aspects and advantages of the invention will be discussed with reference to the Figures and to the detailed description of the preferred embodiments

BRIEF DESCRIPTION OF THE DRAWINGS

The accompanying drawings, which are incorporated in and constitute a part of this specification, illustrate several aspects described below and together with the description, serve to explain the principles of the invention. Like numbers represent the same elements throughout the figures.

DETAILED DESCRIPTION OF THE INVENTION

Figure 1:
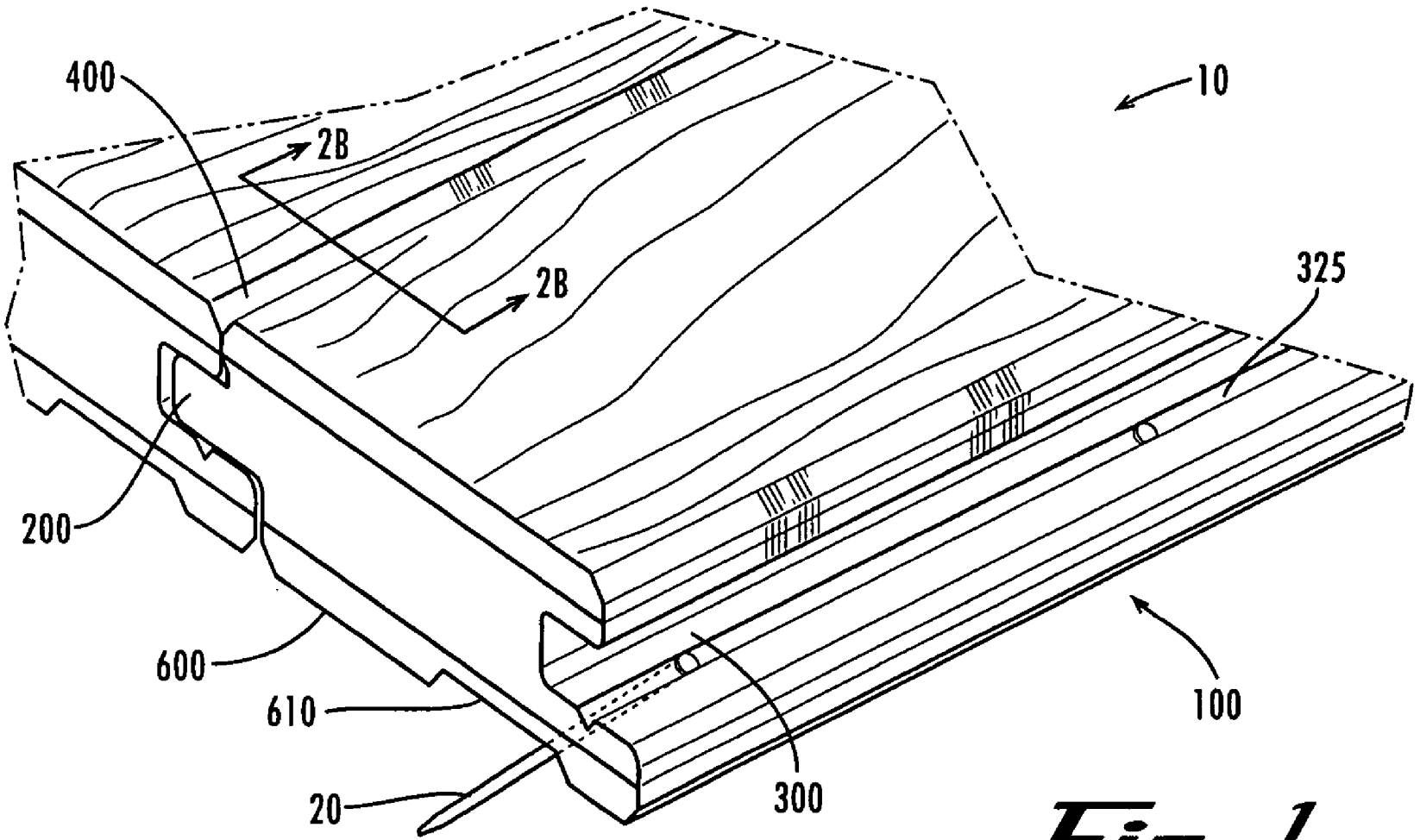
FIG. 1 is a perspective view of one aspect of the present invention for a flooring panel showing adjacent first and second flooring panels coupled with each other and showing a fastened engaged therethrough a longitudinally extending recess defined in a fastening surface of a lower lip of a groove connector member.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting. The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used herein, the singular forms "a," "an" and "the" include plural referents unless the context clearly dictates otherwise. Thus, for example, reference to a "flooring panel" includes aspects having two or more such flooring panels unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The present invention may be understood more readily by reference to the following detailed description of preferred embodiments of the invention and the examples included therein and to the Figures and their previous and following description.

In one aspect, the present invention is a flooring panel 10 that comprises opposed pairs of substantially parallel side edges 100. In one aspect, the flooring panel comprises a tongue and groove edge profile. In this aspect, there is a tongue connector member 200 extending along one side edge of at least one of the opposed pairs of side edges 100. The tongue connector member 200 itself comprises an upper shoulder 210 that extends distally beyond a lower shoulder 220. In yet another aspect, the tongue connector member has a top tongue contact surface 230, a bottom tongue contact surface 240 and a distal peripheral surface 250 that extends between the respective top and bottom tongue contact surfaces.

A groove connector member 300 is defined in one side edge of at least one of the opposed pairs of side edges. As illustrated in FIG. 1, the groove connector member 300 comprises an upper lip 310 and a lower lip 320. In one aspect, the lower lip 320 extends distally beyond the upper lip 310. One skilled in the art would appreciate that the tongue connector member and the groove connector member are configured to cooperatively couple with each other. In another aspect, the lower lip has a fastening surface 322, which is configured to accept a variety of conventional fasteners, such as, for example and not meant to be limiting, one or more nails, staples, tacks, and the like.

As one skilled in the art can appreciate, the flooring panels may be engaged with the subfloor by an adhesive, such as glue. In this aspect, the adhesive is placed on the top surface of the subfloor or the bottom surface 600 of the flooring panel. Since the lower lip of the groove connector member extends distally beyond the upper lip, during installation, the tongue connector member from an adjacent flooring panel 10 may be placed onto the lower lip of the groove connector member that is adhesively secured to the subfloor (at an angle with respect to the subfloor) and slid substantially into engagement prior to the bottom surface of the adjacent flooring panel coming into contact with the adhesive.

In another aspect of the invention, the groove connector member 300 has an upper groove contact surface 330, a lower groove contact surface 340 and a wall surface 350 that extends between the respective top and bottom groove contact surfaces. In one exemplary aspect, at least a portion of the lower groove contact surface 340 is the fastening surface 322.

In another aspect, the tongue connector member 200 and the groove connector member 300 are configured to cooperatively couple with each other such that a distal end 212 of the upper shoulder 210 of a first flooring panel contacts a distal end 312 of the upper lip 310 of a second flooring panel upon coupling of the respective tongue and groove connector members of the respective first and second flooring panels to each other along adjacent side edges. In this fashion, the adjacent flooring panels have the perception of being joined when looking at the flooring system. As one skilled in the art can appreciate and as illustrated in the figures, the distal end 312 of the upper lip of the second flooring panel and the distal end 212 of the upper shoulder of the first flooring panel may be beveled such that, when the adjacent flooring panels are coupled, the seam between the two flooring panels forms a recessed channel 400. A benefit of this feature is to disguise imperfections in the flooring panels to the extent that the uppermost surfaces of the adjacent panels may not be perfectly coplanar.

Figure 2A:
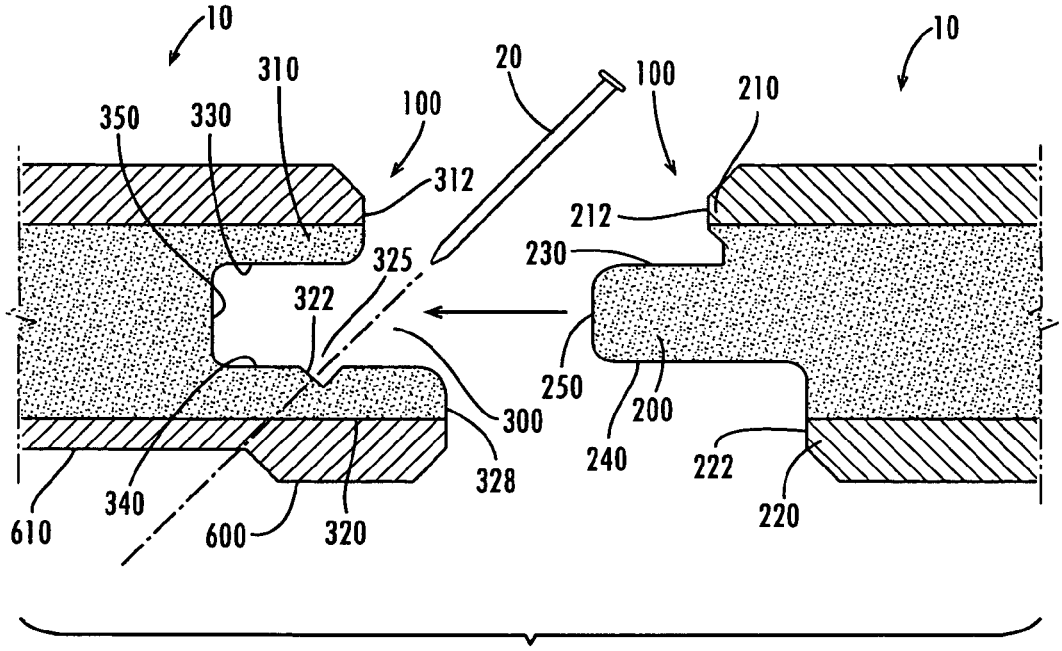
FIG. 2A is a partial end elevational view of the adjacent flooring panels of FIG. 1 in an uncoupled position.
Figure 2B:
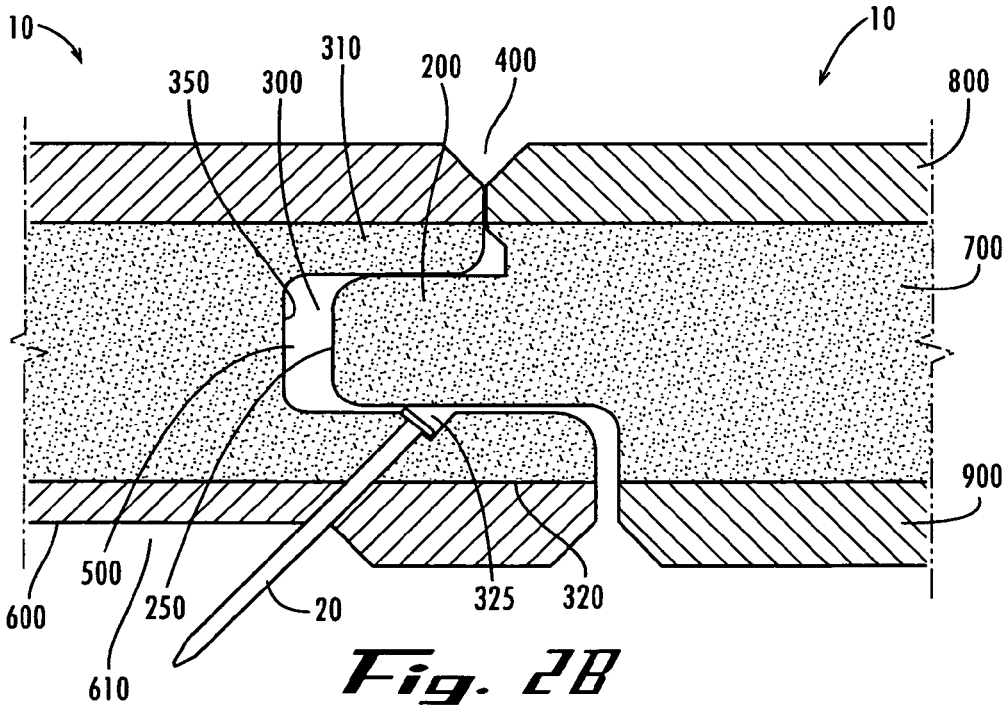
FIG. 2B is a partial cross-sectional view of the adjacent flooring panels of FIG. 1, taken across line 2B-2B of FIG. 1.
Figure 3:
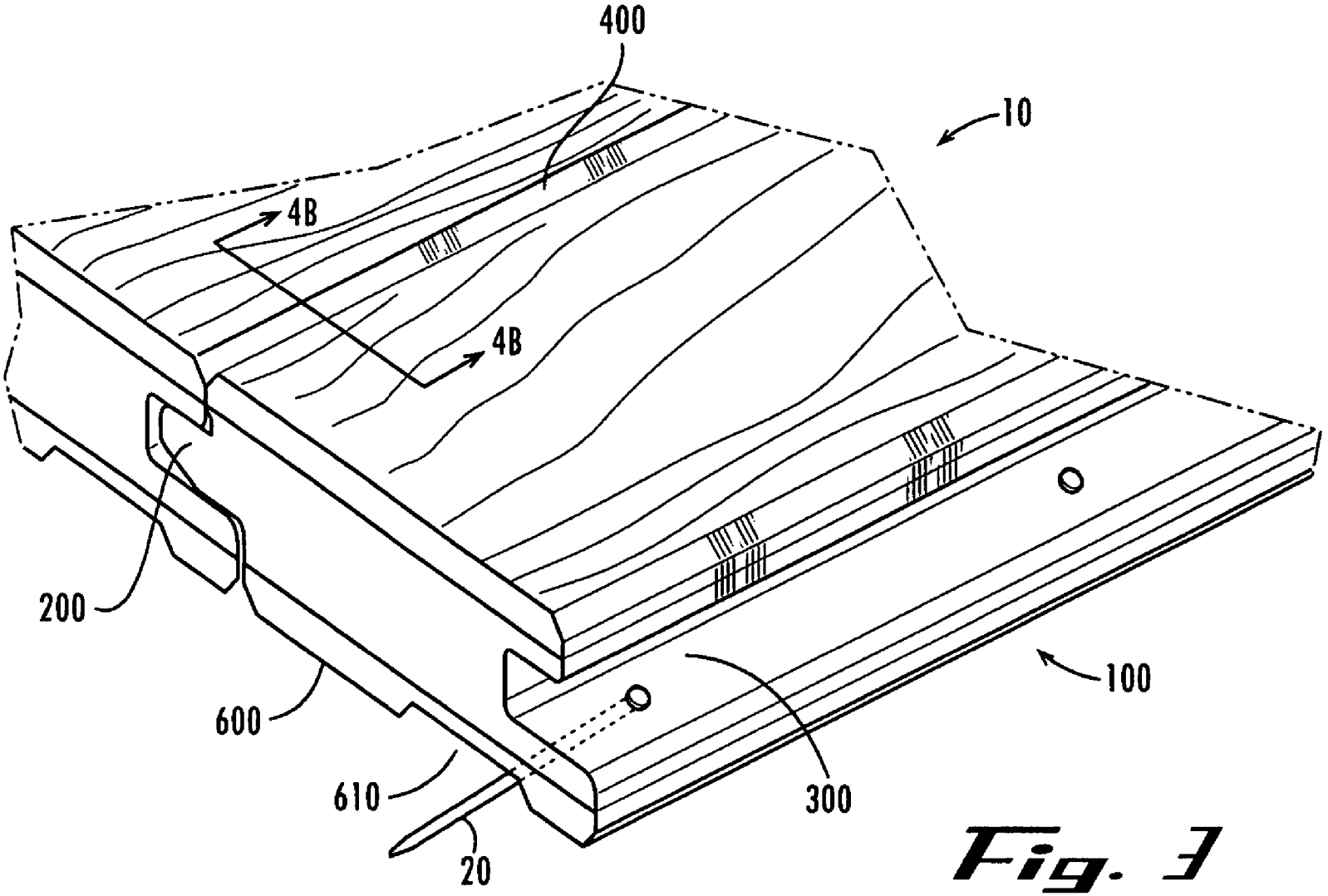
FIG. 3 is a perspective view of one aspect of the present invention for a flooring panel showing adjacent first and a second flooring panels coupled with each other and showing a fastener engaged therethrough a fastening surface of a lower lip of a groove connector member and extending out of a portion of trough defined in a bottom surface of the flooring panel.
Figure 4A:
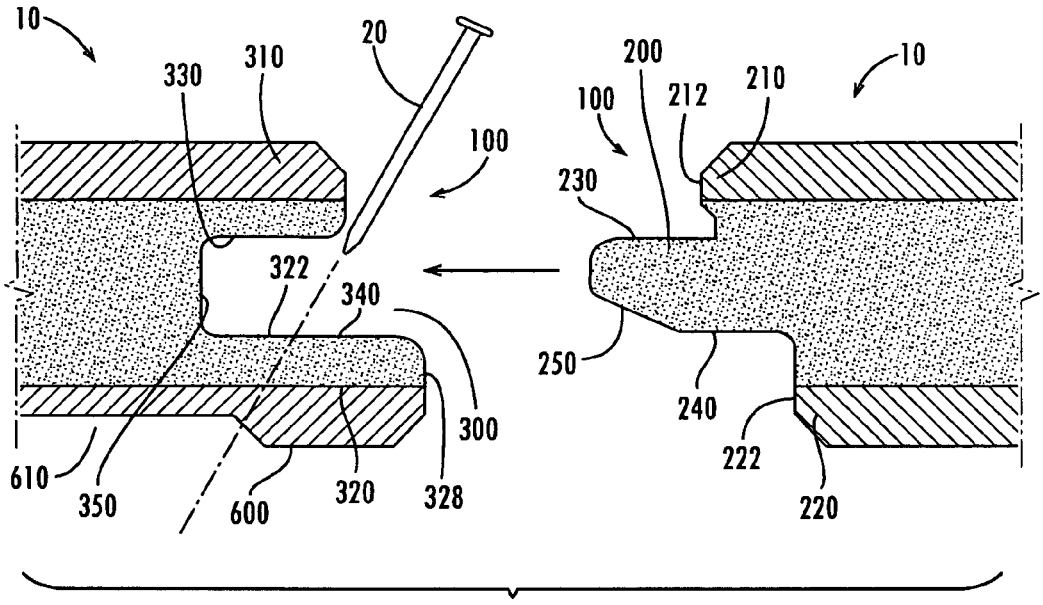
FIG. 4A is a partial end elevational view of the adjacent flooring panels of FIG. 3 in an uncoupled position.
Figure 4B:
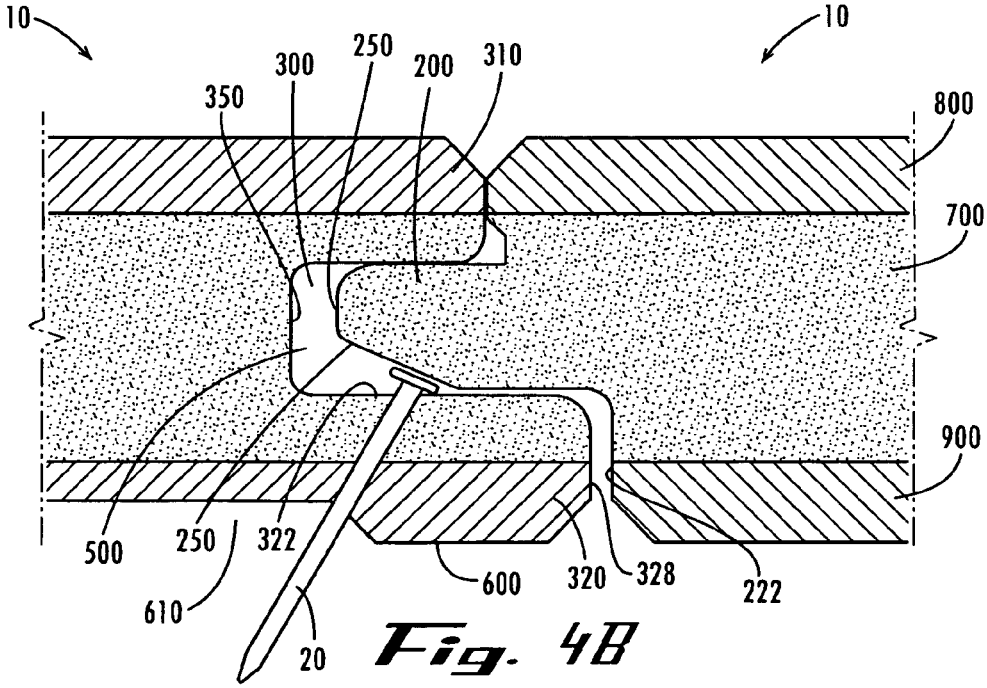
FIG. 4B is a is partial cross-sectional view of the adjacent flooring panels of FIG. 3, taken across line 4B-4B of FIG. 3, showing a distal peripheral surface of the tongue connector member which is angled with respect to a bottom tongue contact surface.

The tongue connector member and the groove connector member may also be configured to cooperatively couple with each other such that a distal end 222 of the lower shoulder 220 of the first flooring panel is spaced from the distal end 328 of the lower lip 320 of the second flooring panel upon coupling of the respective tongue and groove connector members of the respective first and second flooring panels to each other along adjacent side edges 100. As illustrated in FIG. 2B, this clearance helps to ensure that the visable joint on the top surface of the adjoining flooring panels is substantially closed, i.e., portions of the distal ends 212, 312 of the respective adjoining upper shoulder and upper lip are placed in an abutting relationship.

In a further aspect, the tongue connector member and the groove connector member are configured to cooperatively couple with each other such that a portion of the distal peripheral surface of the tongue connector member of the first flooring panel is spaced from a portion of the wall surface 350 of the groove connector member of the second flooring panel upon coupling of the respective tongue and groove connector members of the respective first and second flooring panels to each other along adjacent side edges. The space provides additional clearance to enable the joint to completely close in the event that an obstruction, such as a splinter, or an adhesive, becomes trapped between the distal peripheral surface 250 of the tongue connector member 200 and the wall surface of the groove connector member 300. Further, in one aspect, in a coupled position, the distal peripheral surface of the tongue connector member of the first flooring panel, the wall surface of the groove connector member and portions of the respective upper and lower groove contact surfaces define a longitudinally extending pocket 500.

As mentioned herein above, the fastening surface is provided on the lower lip of the groove connector member, such that a conventional fastener 20 may engage the flooring member with a portion of the subfloor. In conventional flooring profiles the placement of the fastener on a portion of the groove connector member may cause an obstruction when the tongue connector member is attempted to be placed into operative engagement with the groove connector member, which results in the floor panels being placed in an undesirable spaced relationship. This issue is addressed in one aspect of the present invention where a portion of the distal peripheral surface 250 of the tongue connector member that adjoins the bottom tongue contact surface 240 is angled with respect to the bottom tongue contact surface. One will appreciate that, in an adjoined position, the angled portion of the peripheral surface overlies at least a portion of the fastening surface of the lower lip of the groove connector member and thus provides sufficient space so that the tongue connector member 200 can be accepted within the groove connector member 300 without being obstructed by any exposed portion of the fastener 20.

Figure 5:
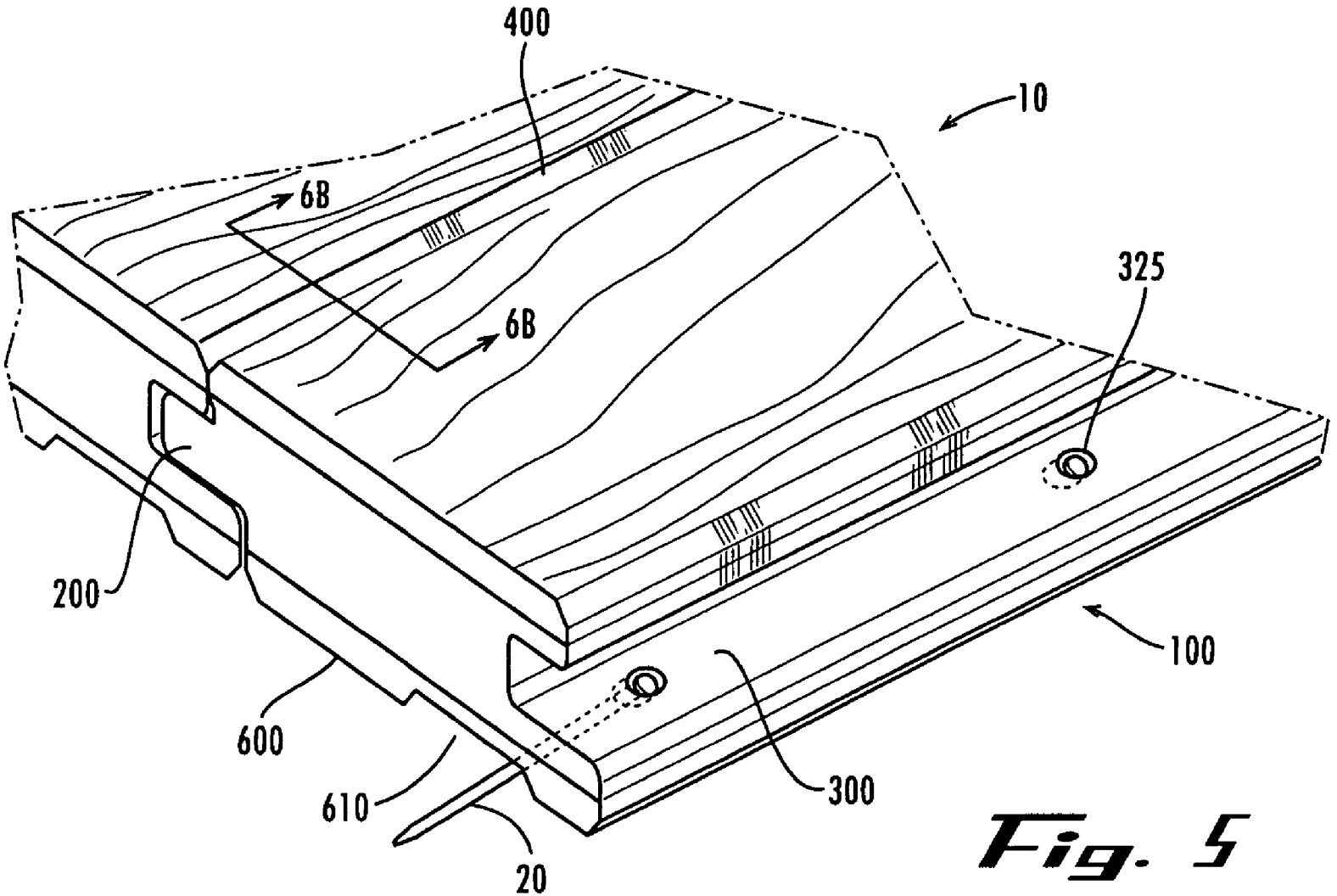
FIG. 5 is a perspective view of one aspect of the present invention for a flooring panel showing adjacent first and second flooring panels coupled with each other and showing a plurality of recesses defined in a fastening surface of a lower lip of a groove connector member.
Figure 6A:
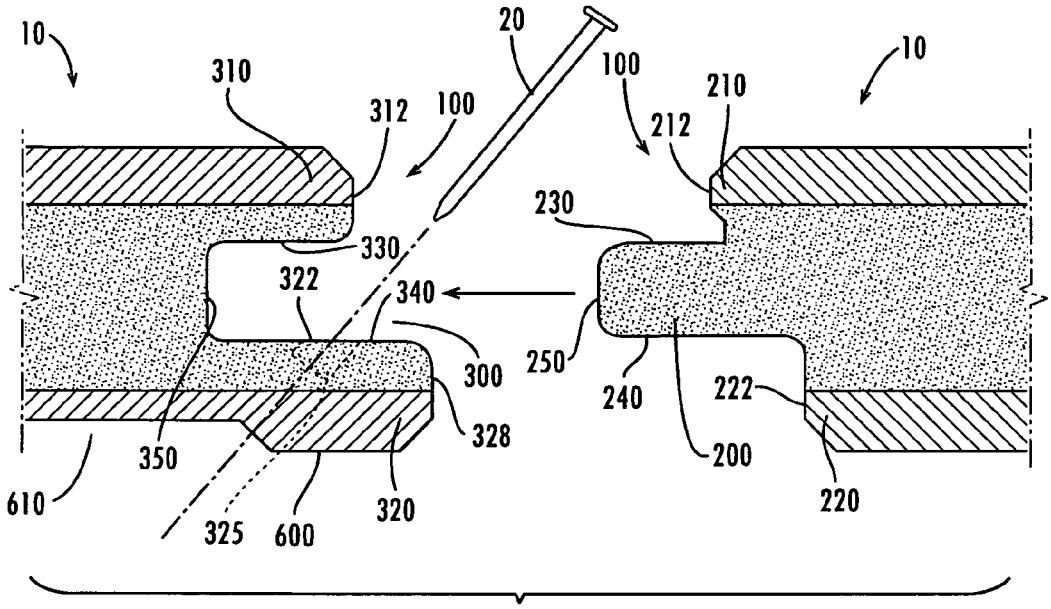
FIG. 6A is a partial end elevational view of the adjacent flooring panels of FIG. 5 in an uncoupled position.
Figure 6B:
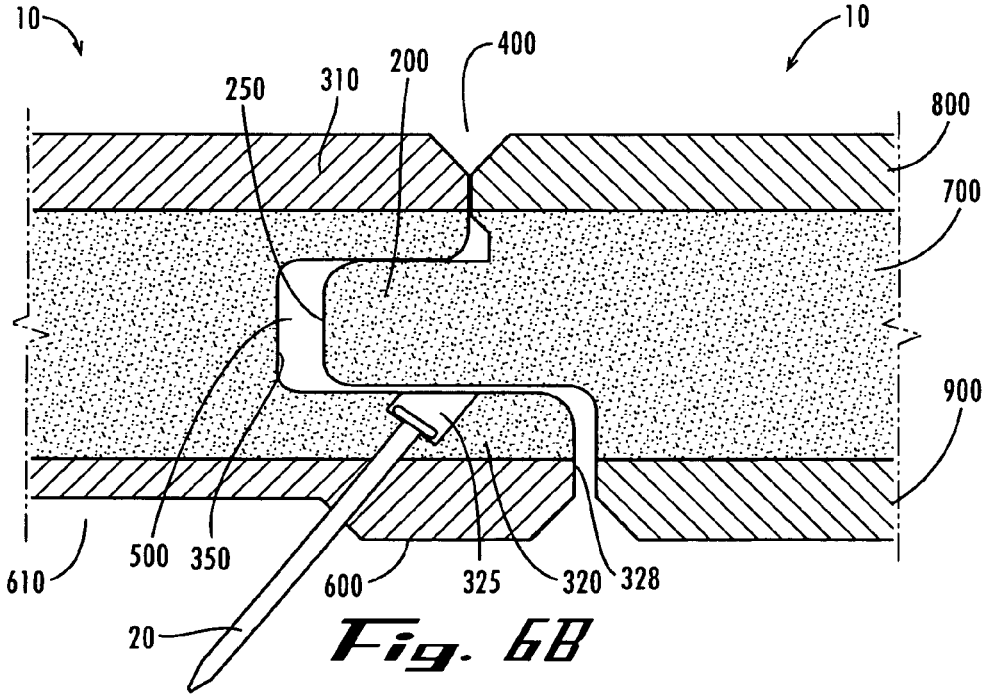
FIG. 6B is a partial cross-sectional view of the adjacent flooring panels of FIG. 5, taken across line 6B-6B of FIG. 5.

In another aspect of the invention, to overcome the possible obstruction issue, the fastening surface defines a recess 325 spaced from the wall surface 350 of the groove connector member that is configured to receive a fastener. As one skilled in the art can appreciate, the groove connector member may comprise one recess or a plurality of recesses. The recess may be shaped to engage an individual fastener, such as in FIG. 5, or it may extend longitudinally substantially parallel to the wall surface of the groove connector member. In yet another aspect, such as in FIG. 1, the recess 325 extends longitudinally substantially the length of the flooring panel. It is contemplated that the recess can be spaced along the longitudinal length of the flooring panel. Further, the recess can be spaced from the ends of the flooring panel.

In some instances, as the fastener 20 extends therethrough the lower lip of the groove connector member and exits through the bottom surface 600 of the flooring panel, it has the potential of splintering either the bottom surface of the flooring panel or the top surface of the subfloor, or both. The splinters may cause the flooring panel to lie on the subfloor in an uneven fashion. To counter this problem, in one aspect, the bottom surface of the flooring panel defines a trough 610 that at least partially underlies the lower lip of the groove connector member 300. The trough 610 is configured to provide a relief space for the formed splinters. In another aspect, the trough is offset from the fastening surface such that it does not underlie the fastening surface 322. In yet another aspect, the trough extends longitudinally substantially parallel to the groove connector member. In this aspect, the trough may or may not extend substantially the longitudinal dimension of the flooring panel.

As one skilled in the art can appreciate, the flooring panel of the present invention may comprise a hardwood material, or it may comprise a plurality of materials in a laminate structure. In one aspect, the flooring panel comprises a wood based core material 700 comprising a ground wood product and a binding agent unified to form a cured composite. As such, the core material 700 may comprise medium density fiberboard ("MDF"), high density fiberboard ("HDF"), or any other conventional wood based product. In yet another aspect, the respective tongue and groove connector members are formed from the core material.

When the flooring panel is a laminate structure, in one aspect, it comprises a decorative layer 800 connected to an upper surface of the core material. The decorative layer 800 may comprise a melamine sheet, as in conventional laminate structures. It may also comprise a hardwood material, as in engineered hardwood flooring panels. However, it may also comprise any other conventional substance used for decorative layers in laminate flooring boards.

In another aspect, the flooring panel comprises a bottom support layer 900 connected to a lower surface of the core material. If the flooring panel comprises a trough 610 defined in its bottom surface, the trough may be defined therein bottom surface of the bottom support layer 900.

In still a further aspect, the invention is a method for making the flooring panel described herein. The method comprises the steps of: providing at least one plank of flooring material; forming the aforementioned tongue connector member into and extending along at least one of the side edges of the pair of opposed side edges; and forming the aforementioned groove connector member into and extending along a side edge opposite of the tongue.

In another aspect, the method comprises forming the aforementioned recess in the fastening surface. As mentioned herein above, the recess may comprise a plurality of recesses. Additionally, the method may also comprise forming the trough in the bottom surface of the flooring panel.

The preceding description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. The corresponding structures, materials, acts, and equivalents of all means or step plus function elements in the claims below are intended to include any structure, material, or acts for performing the functions in combination with other claimed elements as specifically claimed.

Accordingly, those who work in the art will recognize that many modifications and adaptations to the present invention are possible and can even be desirable in certain circumstances and are a part of the present invention. Other embodiments of the invention will be apparent to those skilled in the art from consideration of the specification and practice of the invention disclosed herein. Thus, the preceding description is provided as illustrative of the principles of the present invention and not in limitation thereof. It is intended that the specification and examples be considered as exemplary only, with a true scope and spirit of the invention being indicated by the following claims.

We claim:

1. A flooring panel, comprising:

an upper decorative layer, a bottom support layer, and a core positioned therebetween the upper decorative layer and the bottom support layer, wherein the core comprises a wood based core material comprising ground wood product and a binding agent unified to form a cured composite;

opposed pairs of substantially parallel side edges;

a tongue connector member extending along one side edge of at least one of the opposed pairs of side edges, the tongue connector member comprising an upper shoulder and a lower shoulder, wherein the upper shoulder extends distally beyond the lower shoulder; and a groove connector member defined in one side edge of at least one of the opposed pairs of side edges, the groove connector member defining a groove comprising an upper lip and a lower lip, the lower lip extending distally beyond a distal end of the upper lip wherein a portion of the lower lip of the groove comprises a fastening surface that defines a recess which extends inwardly into the lower lip and which is configured to receive a fastener, and wherein the recess is positioned on a portion of the lower lip that does not extend beyond the distal end of the upper lip;

wherein the tongue connector member is configured to cooperatively couple with the groove connector member.

2. The flooring panel of claim 1, wherein the tongue connector member and the groove connector member are configured to cooperatively couple with each other such that a distal end of the upper shoulder of a first flooring panel contacts the distal end of the upper lip of a second flooring panel upon coupling of the respective tongue and groove connector members of the respective first and second flooring panels to each other along adjacent side edges, and a distal end of the lower shoulder of the first flooring panel is spaced from a distal end portion of the lower lip of the second flooring panel upon coupling of the respective tongue and groove connector members of the respective first and second flooring panels to each other along adjacent side edges.

3. The flooring panel of claim 1, wherein the tongue connector member has a top tongue contact surface, a bottom tongue contact surface and a distal peripheral surface extending between the respective top and bottom tongue contact surfaces.

4. The flooring panel of claim 3, wherein the groove connector member has an upper groove contact surface, a lower groove contact surface and a wall surface extending between the respective upper and lower groove contact surfaces, and wherein at least a portion of the lower groove contact surface is the fastening surface.

5. The flooring panel of claim 4, wherein the tongue connector member and the groove connector member are configured to cooperatively couple with each other such that a portion of the distal peripheral surface of the tongue connector member of the first flooring panel is spaced from a portion of the wall surface of the groove connector member of the second flooring panel upon coupling of the respective tongue and groove connector members of the respective first and second flooring panels to each other along adjacent side edges.

6. The flooring panel of claim 4, wherein, in a coupled position, the distal peripheral surface of the tongue connector member of the first flooring panel, the wall surface of the groove connector member and portions of the respective upper and lower groove contact surfaces define a longitudinally extending pocket.

7. The flooring panel of claim 4, wherein a portion of the distal peripheral surface of the tongue connector member that adjoins the bottom tongue contact surface is angled with respect to the bottom tongue contact surface.

8. The flooring panel of claim 1, wherein the flooring panel has a bottom surface, and wherein the bottom surface defines a trough that at least partially underlies the lower lip of the groove connector member.

9. The flooring panel of claim 8, wherein the trough is offset from the fastening surface such that it does not underlie the fastening surface.

10. The flooring panel of claim 8, wherein the trough extends longitudinally substantially parallel to the groove connector member.

11. The flooring panel of claim 8, wherein the trough extends substantially the longitudinal dimension of the flooring panel.

12. The flooring panel of claim 1, wherein the groove connector member comprises an upper groove contact surface, a lower groove contact surface and a wall surface extending between the respective upper and lower groove contact surfaces, and wherein the recess is spaced from the wall surface of the groove connector member.

13. The flooring panel of claim 12, wherein the recess comprises a plurality of recesses.

14. The flooring panel of claim 12, wherein the recess extends longitudinally substantially parallel to the wall surface of the groove connector member.

15. The flooring panel of claim 12, wherein the flooring panel has a longitudinal length, and wherein the recess extends longitudinally substantially parallel to the wall surface of the groove connector member substantially the longitudinal length of the flooring panel.

16. The flooring panel of claim 1, wherein the core material comprises MDF.

17. The flooring panel of claim 1, wherein the core material comprises HDF.

18. The flooring panel of claim 1, wherein the decorative layer is formed from a hardwood.

19. The flooring panel of claim 1, wherein the bottom support layer has a bottom surface, and wherein the bottom surface defines a trough that at least partially underlies the lower lip of the groove connector member.

20. The flooring panel of claim 19, wherein the trough is offset from the fastening surface such that it does not underlie the fastening surface.

21. The flooring panel of claim 19, wherein the trough extends longitudinally substantially parallel to the groove connector member.

22. The flooring panel of claim 19, wherein the trough extends substantially the longitudinal dimension of the flooring panel.

23. The flooring panel of claim 1, wherein the bottom support layer is formed from a hardwood.

24. A flooring panel, comprising:

an upper decorative layer, a bottom support layer, and a core positioned therebetween the upper decorative layer and the bottom support layer, wherein the core comprises a wood based core material comprising a ground wood product and a binding agent unified to form a cured composite;

a bottom surface underlying the bottom support layer;

opposed pairs of substantially parallel side edges;

a tongue connector member extending along one side edge of at least one of the opposed pairs of side edges, the tongue connector member comprising an upper shoulder and a lower shoulder, wherein the upper shoulder extends distally beyond the lower shoulder; and a groove connector member defined in one side edge of at least one of the opposed pairs of side edges, the groove connector member defining a groove comprising an upper lip and a lower lip, the lower lip extending distally beyond a distal end of the upper lip wherein a portion of the lower lip of the groove comprises a fastening surface that defines a recess which extends inwardly into the lower lip and which is configured to receive a fastener, and wherein the recess is positioned on a portion of the lower lip that does not extend beyond the distal end of the upper lip, and wherein at least the respective upper and lower lips of the groove connector member are defined in the core;

wherein the tongue connector member and the groove connector member are configured to cooperatively couple with each other such that a distal end of the upper shoulder of a first flooring panel contacts the distal end of the upper lip of a second flooring panel upon coupling of the respective tongue and groove connector members of the respective first and second flooring panels to each other along adjacent side edges, and wherein the bottom surface of the flooring panel defines a trough that at least partially underlies the lower lip of the groove connector member.

25. The flooring panel of claim 24, wherein the trough is offset from the fastening surface such that the trough does not underlie the fastening surface.

26. A method for making a flooring panel, comprising:

providing at least one plank of flooring material, each plank comprising a pair of opposed side edges, an upper decorative layer, a bottom support layer, and a core positioned therebetween the upper decorative layer and the bottom support layer, wherein the core comprises a wood based core material comprising ground wood product and a binding agent unified to form a cured composite;

forming a tongue connector member into and extending along at least one of the side edges of the pair of opposed side edges, the tongue connector member comprising an upper shoulder and a lower shoulder, wherein the upper shoulder extends distally beyond the lower shoulder and wherein the tongue connector member comprises a top tongue contact surface, a bottom tongue contact surface, and a distal peripheral surface extending between the respective top and bottom tongue contact surfaces; and forming a groove connector member into and extending along a side edge opposite of the tongue, the groove connector member comprising an upper lip and a lower lip, the lower lip extending distally beyond a distal end of the upper lip, wherein the groove connector member defining a groove comprising an upper groove contact surface, a lower groove contact surface, and a wall surface extending between the respective upper and lower groove contact surfaces, and wherein a portion of the lower groove contact surface comprises a fastening surface that defines at least one recess which extends inwardly into the lower lip and which is configured to receive a fastener, and wherein the recess is positioned on a portion of the lower lip that does not extend beyond the distal end of the upper lip, and wherein at least the respective upper and lower lips of the groove connector member are defined in the core;

wherein the tongue connector member and the groove connector member are configured to cooperatively couple with each other such that a distal end of the upper shoulder of a first flooring panel contacts the distal end of the upper lip of a second flooring panel upon coupling of the respective tongue and groove connector members of the respective first and second flooring panels to each other along adjacent side edges.

27. The method of claim 26, wherein a portion of the distal peripheral surface of the tongue connector member that adjoins the bottom tongue contact surface is angled with respect to the bottom tongue contact surface.

28. The method of claim 26, wherein the at least one recess is spaced from the wall surface of the groove connector member.

29. The method of claim 28, wherein the at least one recess comprises a plurality of recesses.

30. The method of claim 28, wherein the at least one recess extends longitudinally substantially parallel to the wall surface of the groove connector member.

31. The method of claim 26, wherein the core material comprises MDF.

32. The method of claim 26, wherein the core material comprises HDF.

33. The method of claim 26, wherein the decorative layer is formed from a hardwood.

34. The method of claim 26, further comprising forming a trough in the bottom support layer that at least partially underlies the lower lip of the groove connector member.

35. The method of claim 34, wherein the trough is offset from the fastening surface such that it does not underlie the fastening surface.

36. The method of claim 34, wherein the trough extends longitudinally substantially parallel to the groove connector member.

37. The method of claim 34, wherein the trough extends substantially the longitudinal dimension of the flooring panel.

38. The method of claim 26, wherein the bottom support layer is formed from a hardwood.

39. The flooring panel of claim 1, wherein at least the respective upper and lower lips of the groove connector member are defined in the core.

* * * * *